US007382315B1

(12) United States Patent
Stevens et al.

(10) Patent No.: US 7,382,315 B1
(45) Date of Patent: Jun. 3, 2008

(54) SYSTEM FOR AND METHOD OF IMPROVING BEYOND LINE-OF-SIGHT TRANSMISSIONS AND RECEPTIONS

(75) Inventors: James A. Stevens, Allen, TX (US); Raleigh J. Spinks, Jr., Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 774 days.

(21) Appl. No.: 10/387,349

(22) Filed: Mar. 11, 2003

(51) Int. Cl.
*H01Q 3/00* (2006.01)

(52) U.S. Cl. ..... 342/359; 342/360; 342/357.06; 342/357.08; 342/357.1; 455/562.1; 455/63.4

(58) Field of Classification Search ..... 455/101, 455/562.1, 25, 13.3, 139, 180.3, 276.1, 220, 455/63.4, 129, 279.1; 375/347; 343/760, 343/853; 342/359, 360, 350, 357.06, 357.08, 342/357.1; 370/334
See application file for complete search history.

(56) References Cited

U.S. PATENT DOCUMENTS 3,965,422 A * 6/1976 Tagliaferri ..... 455/138
4,107,609 A * 8/1978 Gruenberg ..... 455/16
4,217,591 A * 8/1980 Czerwinski ..... 343/713
4,843,397 A * 6/1989 Galati et al. ..... 342/59
4,878,052 A * 10/1989 Schulze ..... 340/825.69
5,077,686 A * 12/1991 Rubinstein ..... 713/501
5,604,534 A * 2/1997 Hedges et al. ..... 348/144
5,614,914 A * 3/1997 Bolgiano et al. ..... 342/364
5,785,281 A * 7/1998 Peter et al. ..... 244/190
5,842,001 A * 11/1998 Kubota ..... 713/400
5,940,029 A * 8/1999 Ninomiya et al. ..... 342/372
6,002,360 A * 12/1999 Wolcott et al. ..... 342/354
6,018,244 A * 1/2000 Kushida ..... 324/323
6,104,935 A * 8/2000 Smith et al. ..... 455/562.1
6,184,828 B1 * 2/2001 Shoki ..... 342/372
6,195,043 B1 * 2/2001 Azzarelli et al. ..... 342/362
6,201,497 B1 * 3/2001 Snyder et al. ..... 342/357.06
6,366,853 B1 * 4/2002 Whikehart et al. ..... 701/213
6,384,696 B1 * 5/2002 Miller et al. ..... 333/132
6,498,939 B1 * 12/2002 Thomas ..... 455/562.1
6,611,231 B2 * 8/2003 Crilly et al. ..... 342/378
6,642,887 B2 * 11/2003 Owechko ..... 342/373
6,714,983 B1 * 3/2004 Koenck et al. ..... 709/230
6,720,920 B2 * 4/2004 Breed et al. ..... 342/386
6,760,593 B1 * 7/2004 Driessen ..... 455/500

(Continued)

OTHER PUBLICATIONS

Field Manual No. FM 24-18: *Tactical Single-Channel Radio Communications Techniques,* Headquarters, Department of the Army, Washington, D.C., Sep. 30, 1987, retrieved from http://155.217.58.58/cgi-bin/atd1.d11/fm/24-18/fm24-18.htm.

*Primary Examiner*—Matthew Anderson
*Assistant Examiner*—Dominic E. Rego
(74) *Attorney, Agent, or Firm*—Nathan O. Jensen; Kyle Eppele

(57) ABSTRACT

A radio system can be configured as a beyond line-of-sight system and includes a number of antennas, a number of phase adjusters and a transmitter/receiver unit. Each of the phase adjusters can be associated with a respective antenna of the antennas. The antennas can be disposed on separate platforms. The transmitter/receiver unit communicates with the phase adjusters. The communicating allows the beyond-line-of-sight system to use the antennas as a larger virtual antenna.

21 Claims, 8 Drawing Sheets

U.S. PATENT DOCUMENTS 6,879,831 B2 * 4/2005 Hamabe ..... 455/442
6,917,792 B2 * 7/2005 Kim ..... 455/127.5
2001/0043156 A1 * 11/2001 Matsui et al. ..... 342/417
2002/0018483 A1 * 2/2002 Kuwabara et al. ..... 370/430
2002/0050943 A1 * 5/2002 Toda et al. ..... 342/357.04
2002/0115452 A1 * 8/2002 Whikehart et al. ..... 455/456
2002/0135524 A1 * 9/2002 Zimmerman et al. ..... 343/760
2003/0071760 A1 * 4/2003 Ngo Bui Hung et al. ... 343/844
2003/0103004 A1 * 6/2003 Arndt et al. ..... 342/465
2003/0156056 A1 * 8/2003 Perry ..... 342/82
2003/0227422 A1 * 12/2003 Berry et al. ..... 343/895
2004/0104844 A1 * 6/2004 Rooyen et al. ..... 342/377
2004/0176102 A1 * 9/2004 Lawrence et al. ..... 455/456.1
2005/0012660 A1 * 1/2005 Nielsen et al. ..... 342/357.06
2005/0192727 A1 * 9/2005 Shostak et al. ..... 701/37
2007/0001899 A1 * 1/2007 Lawrence et al. ..... 342/357.06

* cited by examiner

SYSTEM FOR AND METHOD OF IMPROVING BEYOND LINE-OF-SIGHT TRANSMISSIONS AND RECEPTIONS

FIELD OF THE INVENTION

The present invention relates to wireless communication systems. More particularly, the present invention relates to a system for and method of providing a virtual antenna and/or improving transmission and reception of beyond line-of-sight systems, such as communication systems.

BACKGROUND OF THE INVENTION

Wireless communication systems, such as radio frequency (RF) communication systems, include an antenna for receiving and transmitting RF signals. Antennas can be fabricated according to a number of different designs and sizes. Certain types and sizes of antennas provide better transmission and reception for certain types of communications. Antennas for RF communication systems are often affixed to military and civilian naval, ground and airborne vehicles, personnel or platforms for relaying messages and data.

When line-of-sight RF communications are not possible for terrestrial communications systems, communications are performed using infrastructure-based systems or using beyond line-of-sight HF communication systems. An infrastructure-based systems, such as, satellite systems, or man-made infrastructure systems, such as, wire line systems, are expensive. These systems require equipment to be placed in or above the atmosphere or on land to assist the communication. The infrastructure-based systems must be available in the particular area for which communications are pending. Also, the infrastructure can be vulnerable to enemy destruction.

Beyond line-of-sight communications systems rely on the transmission of radio waves to the ionosphere and the bouncing of those radio waves off the ionosphere to a recipient. The range for the communications is increased as compared to line-of-sight terrestrial wireless communication systems by bouncing RF signals off the ionosphere.

An example of an incident communication or beyond line-of-sight system is a high frequency (HF) communications system. HF communication systems generally utilize the 3-33 megahertz (MHz) frequency range and require large antennas due to the larger wavelength associated with RF signal. One example of an incident HF communication system, the HF near-vertical incident skywave (NVIS) radio, supports a range of communication across a range of approximately 5 to 100 miles. Examples of HF NVIS for military communication system programs include the U.S. Army War Fighter Information Network—Terrestrial (WIN-T) system, the U.K. Ground Recognized Air Picture Initial Operating Capability (GRAP IOC) system, the Taiwan Advanced Technical Data Link (TATDL) system and the HF Nap-of-the-Earth (NOE) ARC220 radio for the U.S. Army.

With reference to FIG. 1, a graph 19 shows the operational effectiveness as a function of range for several antenna types used with the conventional AN/PRC-74 radio in mountainous and varied terrain including jungles in Thailand. A Y axis 21 represents a ratio of messages received over the total messages transmitted and an X axis 23 represents range in miles.

Graph 20 is an approximation of FIG. M-15 from Army Field Manual FM241-18. Graph 20 shows message reliability for three types of HF antennas: a dipole antenna, a slant antenna, and a whip antenna.

An HF whip antenna is generally an omnidirectional antenna that can be easily and quickly assembled and directed. It is typically lightweight and easy to carry but has limited range with conventional radios. Whip antennas are often comprised of a somewhat flexible conductor mounted at one end to a radio housing, a vehicle or other platform.

An HF dipole antenna generally requires two or more supports. It utilizes a conductor or wire connected between two or more supports or poles. Although assembly is relatively easy and extended ranges are possible with dipole antennas, operation on-the-move is not available. Since HF dipole antennas are often greater than 100 feet long.

A HF slant wire antenna generally requires only a single vertical support. A conductor or wire is connected to the single vertical support and the ground. Slant wire antennas can be deployed in a clearing using a tent pole and a length of conductor or wire. The slant wire antenna, similar to the dipole antenna, can be longer than 100 yards and provides an effective vertical takeoff angle that can be used to bounce the RF signals off the ionosphere.

Both the dipole antenna and slant wire antenna require greater setup time than the whip antenna and utilize a substantially longer conductor. Large setup times (from over one to two minutes) are not desired in rapid deployments. Further, large setup times hinder operations which require the radio system to be portable or on-the-move.

Referring to graph 19 in FIG. 1, the probability area for the large dipole antenna is represented by the area within dotted and dashed line 25. The probability area for the slant wire antenna is represented by the area enclosed by dotted line 27. The probability for whip antennas is represented by the area surrounded by solid line 29. As can be shown in FIG. 1, the larger dipole antennas have a significantly higher probability of properly receiving and transmitting messages followed in order of highest probability by slant wire antennas and whip antennas, respectively.

As shown in graph 19, the most portable antenna, the whip antenna, has the poorest probability of complete transmissions and receptions (the area enclosed by solid line 29). This factor is especially disadvantageous because the whip antenna is a more practicable antenna for utilization on vehicles or other mobile platforms. Transmission and reception in ranges from 10 to 60 miles is especially poor with the whip antenna. Takeoff angles for smaller antennas, such as, the whip antenna do not have the vertical takeoff angles associated with dipole antennas and therefore have reduced gain.

Therefore, there is a need for an HF NVIS system which can be available for rapid deployments. Further, there is a need for an HF NVIS radio that can be operated on the move. Further still, there is a need for an HF NVIS radio system which has increased transmission and reception performance and can utilize whip antennas. Yet further, there is a need for a method of operating a radio system that improves reception and transmission and can utilize whip antennas. Yet even further, there is a need for a terrestrial communication system for providing for stable communications across a range from zero to 100 miles and yet not require large setup times or significant infrastructure. The approach given below can be used to provide a virtual antenna to other beyond line-of-sight radio propagation paths, such as "regular" HF skywave, meteor burst, or troposcatter systems.

SUMMARY OF THE INVENTION

An exemplary embodiment relates to a beyond radio frequency system. The beyond line-of-sight system includes a number of antennas, a number of phase adjusters, and a transmit/receiver unit. Each of the phase adjusters is associated with a respective antenna of the antennas. The antennas are disposed on separate platforms. The radio communicates with the phase adjusters. The communication between the radio unit and the phase adjusters allows the beyond line-of-sight system to use the antennas as a larger virtual antenna.

Another exemplary embodiment relates to a radio unit for use in a communication system including a number of antennas. The radio unit includes a high speed communication interface and a processor coupled to the high speed communication interface. The processor receives information from the high speed interface. The information is associated with a position or relative position of the antennas. The processor adjusts phase associated with signals transmitted from or received on the antennas in response to the information.

Still another exemplary embodiment relates to a method of operating a beyond line-of-sight system including a number of antennas. The method includes receiving signals indicating a position or relative position of the antennas, and adjusting phase of signals received on or transmitted to the antennas to cause the antennas to operate as a larger virtual antenna.

Still another exemplary embodiment relates to a radio unit for an HF NVIS radio system. The HF NVIS radio system includes a number of whip antennas. The radio unit includes means for receiving signals indicating a position or a relative position of the whip antennas, and means for adjusting the phase of signals received on or transmitted to the whip antennas to cause the whip antennas to operate similar to a phased array antenna.

Alternative exemplary aspects of the invention can utilize a radio unit for providing feedback signals to the phase adjusters. Another alternative exemplary aspect of the invention can include the use of an environment sensor to provide further information so that the phase adjusters can be further adjusted in accordance with the environment.

BRIEF DESCRIPTION OF THE DRAWINGS

The exemplary embodiments in the present invention will be described with reference to the accompanying drawings, wherein like numerals denote like elements.

DETAILED DESCRIPTION OF THE PREFERRED EMBODIMENTS

Figure 2:
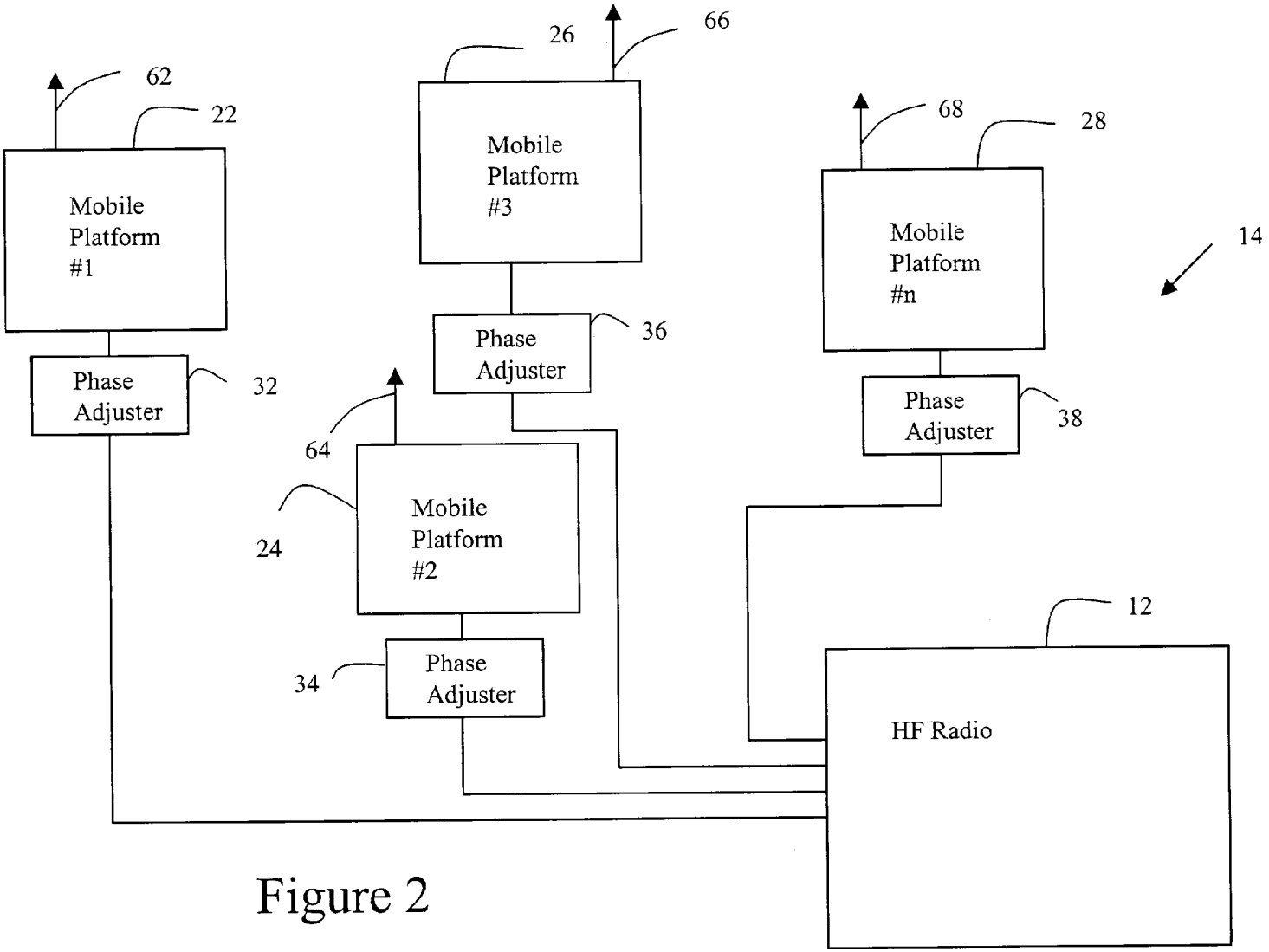
FIG. 2 is a general block diagram of an HF NVIS radio system including a radio unit, several antennas, and several phase adjusters in accordance with an exemplary embodiment.

With reference to FIG. 2, a high frequency, near vertical incident sky wave (HFNVIS) radio system 14 includes two or more mobile platforms, such platforms 22, 24, 26 and 28, an HF radio unit 12, antennas 62, 64, 66 and 68, and phase adjusters 32, 34, 36 and 38. Platforms 22, 24, 26 and 28 can be vehicles, such as, troop transport vehicles, trailers, tanks, automobiles and artillery, or can be backpacks, radio housings, or any structure upon which an antenna can be disposed. Alternatively, system 14 can be any beyond line-of-sight system such as a meteor burst or troposcatter system.

Antennas 62, 64, 66 and 68 are preferably lightweight and mobile and are not dipole or slant wire antennas requiring connection to the ground or to two fixed points. In one embodiment, antennas 62, 64, 66 and 68 are whip antennas such as those provided on vehicles or on personnel carried radio units. In general, antennas 62, 64, 66 and 68 can have a length of 10-20 feet (e.g., a 15-foot whip antenna). Antennas 62, 64, 66 and 68 are preferably antennas that can be utilized on-the-move operations as well as antennas which are easily set up for rapid deployment operations. Antennas 62, 64, 66 and 68 can be Y-shaped, C-shaped, bent, or straight antennas. Antennas 62, 64, 66 and 68 can be dipole antennas tied down for mobile use or a loop antenna.

Transmissions and receptions from and to system 14 are processed through HF radio 12. HF radio 12 uses phase adjusters 32, 34, 36 and 38 to advantageously cause the combination of antennas 62, 64, 66 and 68 to appear as a larger antenna. In this way, system 14 adjusts phase adjusters 32, 34, 36 and 38 so that transmission/reception of multiple transmissions/receptions on antennas 62, 64, 66 and 68 appears as a signal transmission/reception by a larger antenna. Therefore, system 14 uses a larger virtual HF antenna through the use of adjusters 32, 34, 36 and 38 and processing by radio unit 12.

Radio unit 12 preferably receives information about antennas 62, 64, 66 and 68 to make adjustments according to phase adjusters 32, 34, 36 and 38. In one embodiment, the information includes position information or relative position information so that distances or distances and orientations between antennas 62, 64, 66 and 68 can be determined. With this information, digital signal processing techniques can be utilized through radio unit 12 and adjusters 32, 34, 36 and 38 to make antennas 62, 64, 66 and 68 appear as a virtual antenna.

In addition, the information can include antenna characteristic information such as the type and size of antennas 62, 64, 66 and 68, as well as the configuration of the antenna (e.g., in a C-shape or bent whip configuration). The shape and orientation of antennas affects the phase adjustments calculations. In a preferred embodiment, antennas 62, 64, 66 and 68 can be employed across an area (e.g., a circle rather than a straight line). The information can also include the measured frequency response associated with an antenna.

As discussed above, system 14 utilizes antenna 62, 64, 66 and 68 to make a phase-array type of antenna from generally mobile antennas. The phase adjustments for antennas 62, 64, 66 and 68 are coordinated in time with each antenna signal being injected in a particular time by a traffic master, such as HF radio unit 12. The timing or phase adjustments are made by knowing relative distances between nodes (platforms 22, 24, 26 and 28), antenna shapes and types, antenna orientations, etc.

Phase adjusters 32, 34, 36, 53 (FIG. 5), 38 and 150 (FIG. 3) are preferably configured as digital modem processors. In one embodiment, phase adjusters 32, 34, 36 and 38 and 150 are embodied in hardware circuitry or electronic control circuits that can adjust radiated transmissions. Adjusters 32, 34, 36, 38, 53 and 150 can be operable in a variety of different HF modulation techniques, including AM, FM, etc. Preferably, platforms 22, 24, 26 and 28 each include individual HF radio circuits for receiving and transmitting the signal. Conventional HF radio circuits in accordance with principles of the present invention can be utilized.

Preferably, the radio circuits include an adjustment for transmit power which can be controlled through HF radio units 51 (FIGS. 4-8), 12 (FIG. 2), 20 (FIG. 3) and 29. Preferably, each of platforms 22, 24, 26 and 28 includes a computer executing software for providing timing and adjustments and control of respective phase adjusters 32, 34, 36, 38, 53 and 150. In one embodiment, the computer circuitry includes a microprocessor and/or digital signal processor executing software. In another embodiment, an application specific circuit (ASIC) can be utilized.

System 14 can operate in at least three modes. In a first mode, system 14 is operated while platforms 22, 24, 26 and 28 are on-the-move. HF radio 12 communicates with platforms 22, 24, 26 and 28 to obtain position information about antennas 62, 64, 66 and 68 via a wireless high speed link described in greater detail with reference to FIGS. 6-8. Platforms 22, 24, 26 and 28 are preferably within ten to hundreds of feet (e.g., line-of-sight) and capable of communicating data while moving.

In a second mode, system 14 can operate while stopped and a high speed link can utilize a fiber optic or other high speed cable. In a third mode, system 14 is operated while stopped and radio unit 12 operates using the high speed wireless link similar to mode 1. The position information can be entered to HF radio 12 manually or through other techniques in the second and third modes. Position information can be entered manually if measurement or positioning information is available by other methods.

Although phase adjusters 32, 34, 36 and 38 can be provided anywhere in system 14. A most preferred exemplary embodiment utilizes phase adjusters 32, 34, 36 and 38 within a computer and radio disposed on platforms 22, 24, 26 and 28, respectively. In this way, each of platforms 22, 24, 26 and 28 provide data representative of the received signals on antenna 62, 64, 66 and 68 through phase adjusters 32, 34, 36 and 38, respectively. HF radio unit 12 controls the phase adjusters 32, 34, 36 and 38 in response to the information provided across the high speed wireless link or other link.

In one embodiment, high speed interfaces 39 and 63 (FIGS. 6-8) are capable of transferring information approximately several hundred yards on-the-move. Interfaces 39 and 63 can be a joint tactical radio system (JTRS) wideband networking system such as a wideband networking waveform (WNW) system. In another embodiment, interfaces 39 and 63 can be part of a free space optical communication system (e.g., a laser system). Interfaces 39 and 63 can be capable of transmitting data at a rate of up to megabits per second. Alternatively, interfaces 39 and 63 can be an 802.11B type system, an ethernet system, or other network interface.

In one embodiment, radio unit 12 also determines the availability of antennas 62, 64, 66 and 68 through the high speed wireless interface. Antennas 62, 64, 66 and 68 may not be available due to equipment failure, destruction of one of the platforms 22, 24 or 28, transmission reception difficulty, etc. Radio unit 12 can reconfigure system 14 in the event that one or more antennas of antennas 62, 64, 66 and 68 are not available. Radio unit 12 can use interrogation signals or information transmitted via the wireless interface to determine the availability of equipment associated with antennas 62, 64, 66 and 68. Ad hoc networking techniques can be utilized to provide timing for transmissions and for determining equipment availability in system 14.

Figure 3:
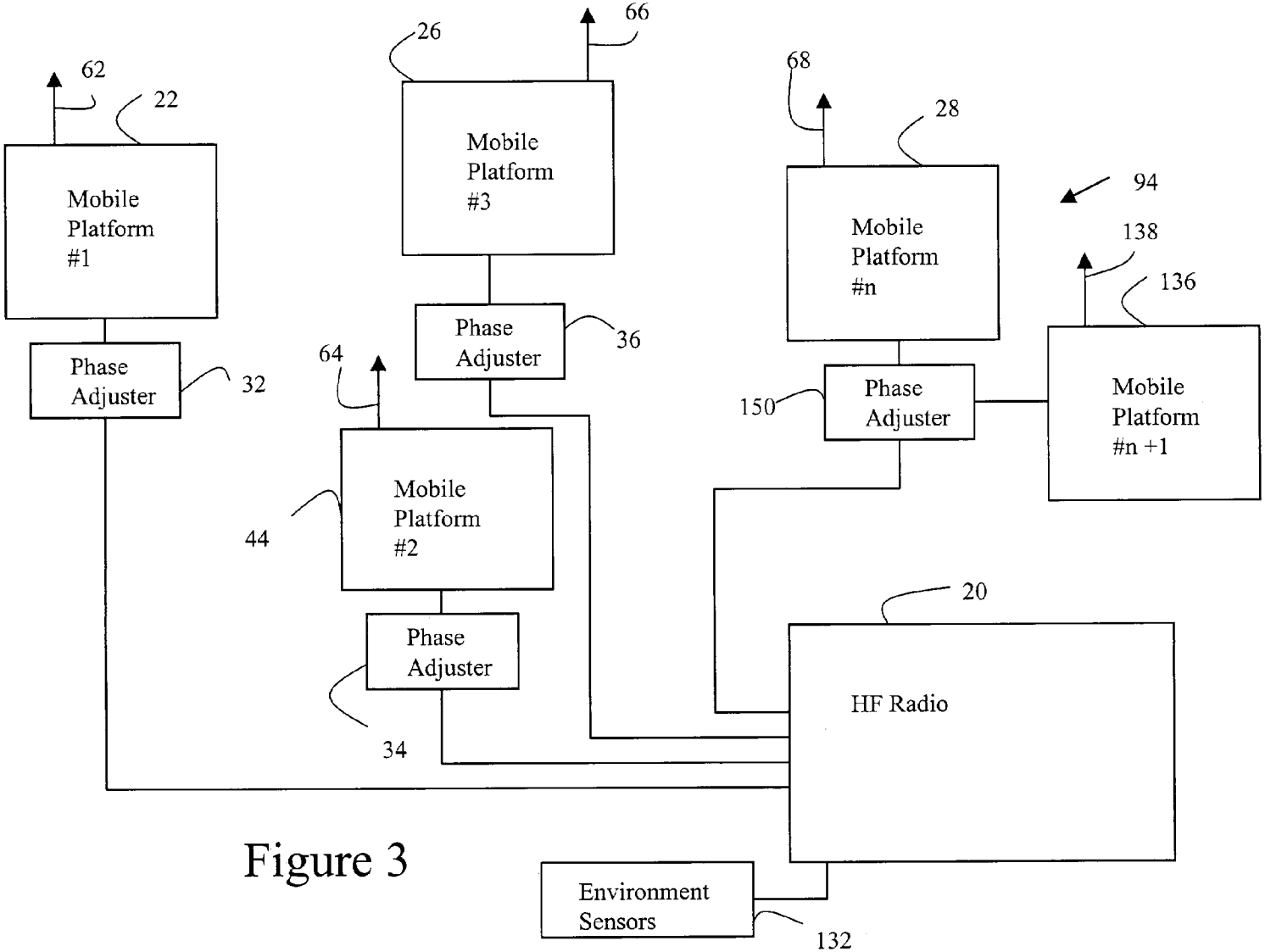
FIG. 3 is a general block diagram of another HF NVIS radio system similar to the system illustrated in FIG. 2 in accordance with another exemplary embodiment, the system of FIG. 3 includes an environment sensor and a monitoring antenna.

With reference to FIG. 3, system 94 is similar to system 14. However, system 94 also includes an additional mobile platform 136 including an antenna 138. Antenna 138 is utilized to receive transmissions provided from antennas 62, 64, 66 and 68. In this embodiment, antenna 138 receives a signal for providing a feedback signal to HF radio unit 20 or phase adjuster 150.

In one embodiment, the signals from mobile platform 136 are utilized to adjust at least one of phase adjusters 32, 34, 36 and 150. In another embodiment, signals from mobile platform 136 can be provided to HF radio unit 20 to make the adjustments for proper reception based upon the received signal at antenna 138. Signal strength can be utilized to provide proper feedback. Alternatively, phase measurements or other signal status signal status characteristics can be utilized to make the appropriate adjustments.

The use of the information received at antenna 138 is particularly effective as antennas 62, 64, 66 and 68 become distorted due to mechanical deflections as platforms 22, 24, 26 and 28 are bounced, operate beneath trees, etc. These mechanical deflections change the characteristics of antennas 62, 64, 66 and 68 and adjustments can be made so that the appropriate radiated patterns are transmitted or received by antennas 62, 64, 66 and 68 in response to feedback generated from receptions on antenna 138. Platform 136 preferably includes radio and computer hardware for antenna 138. A high speed wireless link couples unit 20 and platform 136.

System 94 also includes at least one environment sensor 132. Environment sensor system 132 can be employed on any of or all platforms 22, 24, 26, 28 and 136 and can communicate with radio unit 20 by the high speed wireless link. Alternatively, unit 20 can be directly coupled or integrated with system 132.

Environment sensor system 132 can sense ground conductivity or dielectric constants associated with the ground. These factors can affect the transmissions and receptions of system 94. HF radio unit 20 utilizes the measured characteristics from sensor system 132 to adjust signals provided to and received at antennas 62, 64, 66 and 68.

Environment sensor system 32 can determine whether the ground is wet or dry, and the type of ground surface (e.g., sand, grass, water, etc.) Ground environment affects how the ground plane appears to the virtual antenna associated with antennas 62, 64, 66 and 68.

Figure 4:
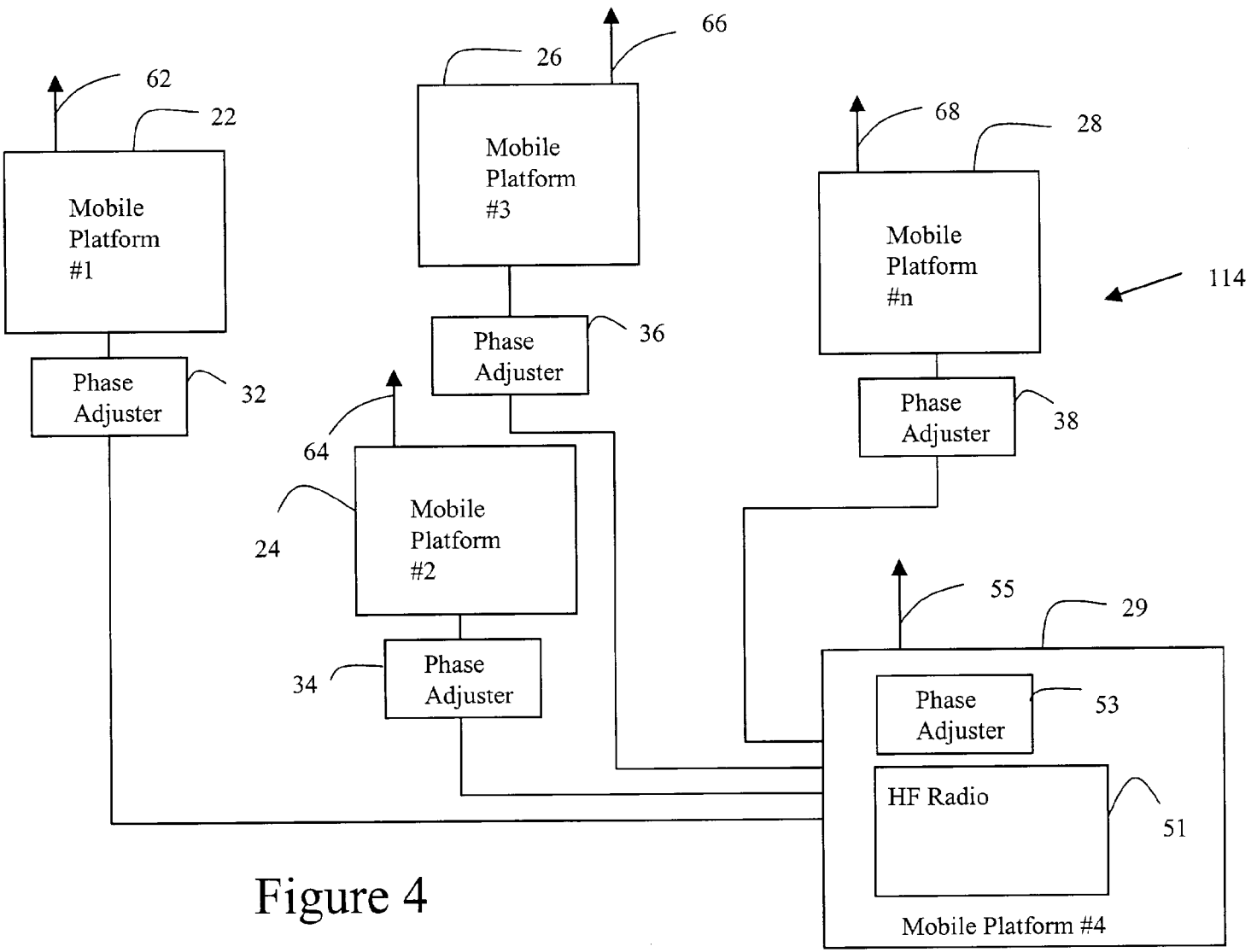
FIG. 4 is a general block diagram of yet another HF NVIS radio system similar to the system illustrated in FIG. 2 in accordance with still another exemplary embodiment, the system of FIG. 4 includes a phase adjuster and an antenna for a mobile platform upon which the radio unit is disposed.

With reference to FIG. 4, system 114 is similar to system 14 and includes an additional mobile platform 29 for housing an HF radio unit 51 similar to HF radio unit 12. HF radio unit 51 disposed upon mobile platform 29 further includes a phase adjuster 53 for adjusting phase associated within antenna 55 on mobile platform 29. Unit 51 provides adjustments for antennas 62, 64, 66 and 68 as well as its own antenna 55. Phase adjusters 32, 34, 36 and 38 can be provided with parts or components located in or near antennas 62, 64, 66 and 68, mobile platforms 22, 24, 26 and 28, or radio unit 51.

Figure 5:
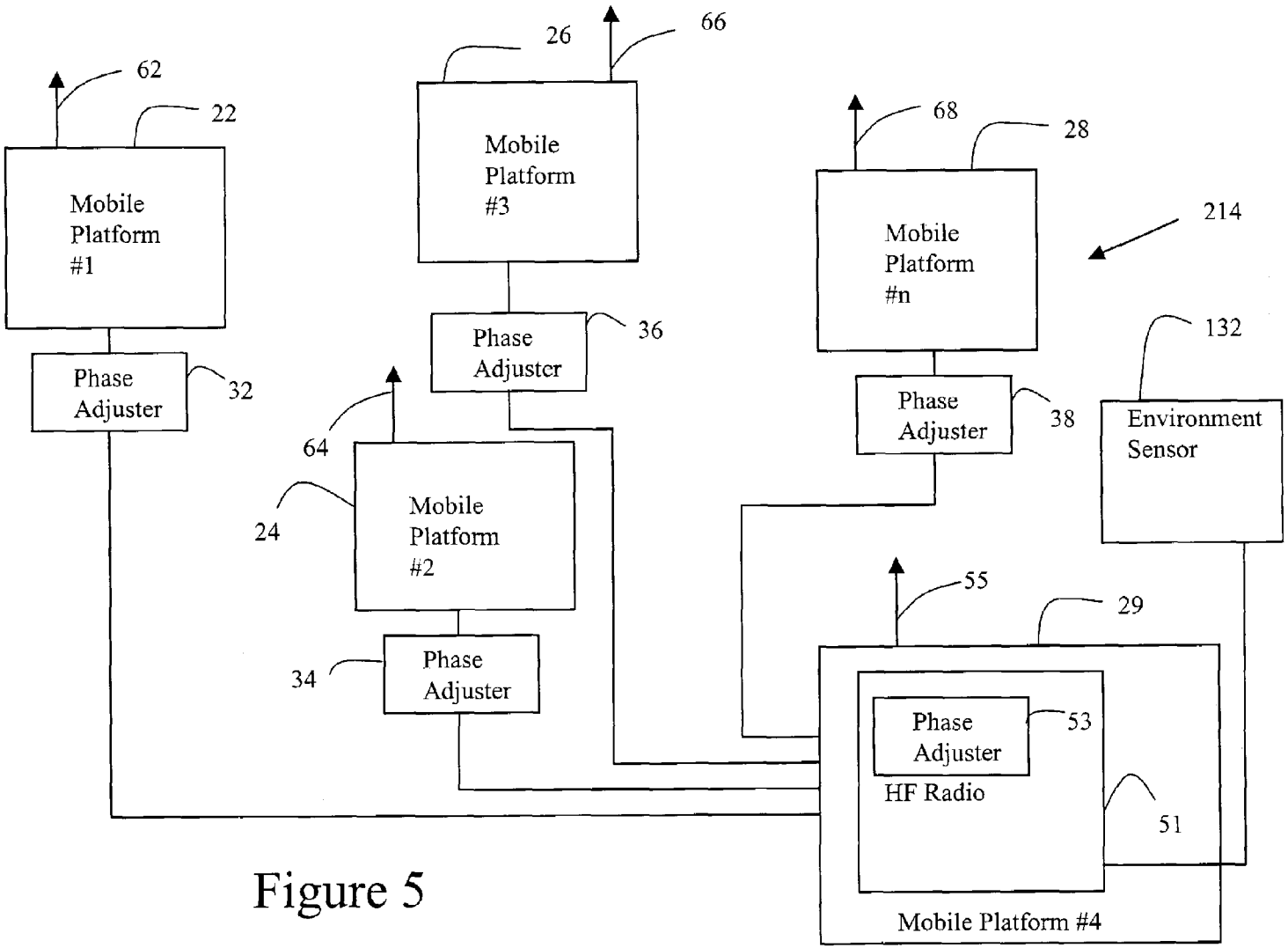
FIG. 5 is a general block diagram of still another HF radio system similar to the system illustrated in FIG. 2 in accordance with yet still another exemplary embodiment, the system of FIG. 5 includes a phase adjuster within the radio unit.

With reference to FIG. 5, HF system 214 is similar to systems 98 and 14 discussed with reference to FIGS. 2-4. However, HF radio unit 51 of system 214 includes an internal or integrated phase adjuster 53 to adjust signals associated with antenna 55.

Figure 1:
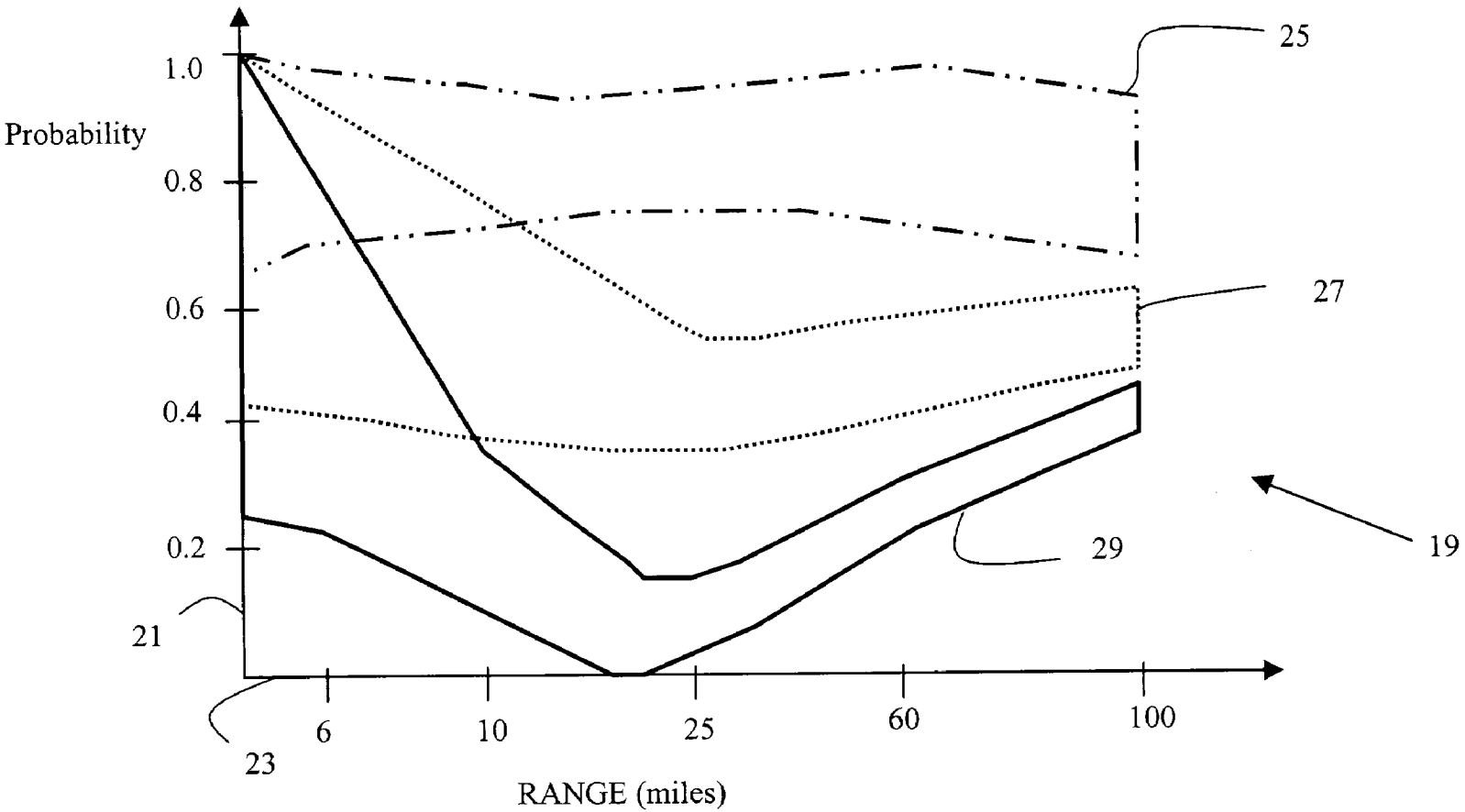
Figure 1 (Prior Art)
FIG. 1 is a graph showing operational performance of several antenna types used with a conventional HF radio system.
Figure 6:
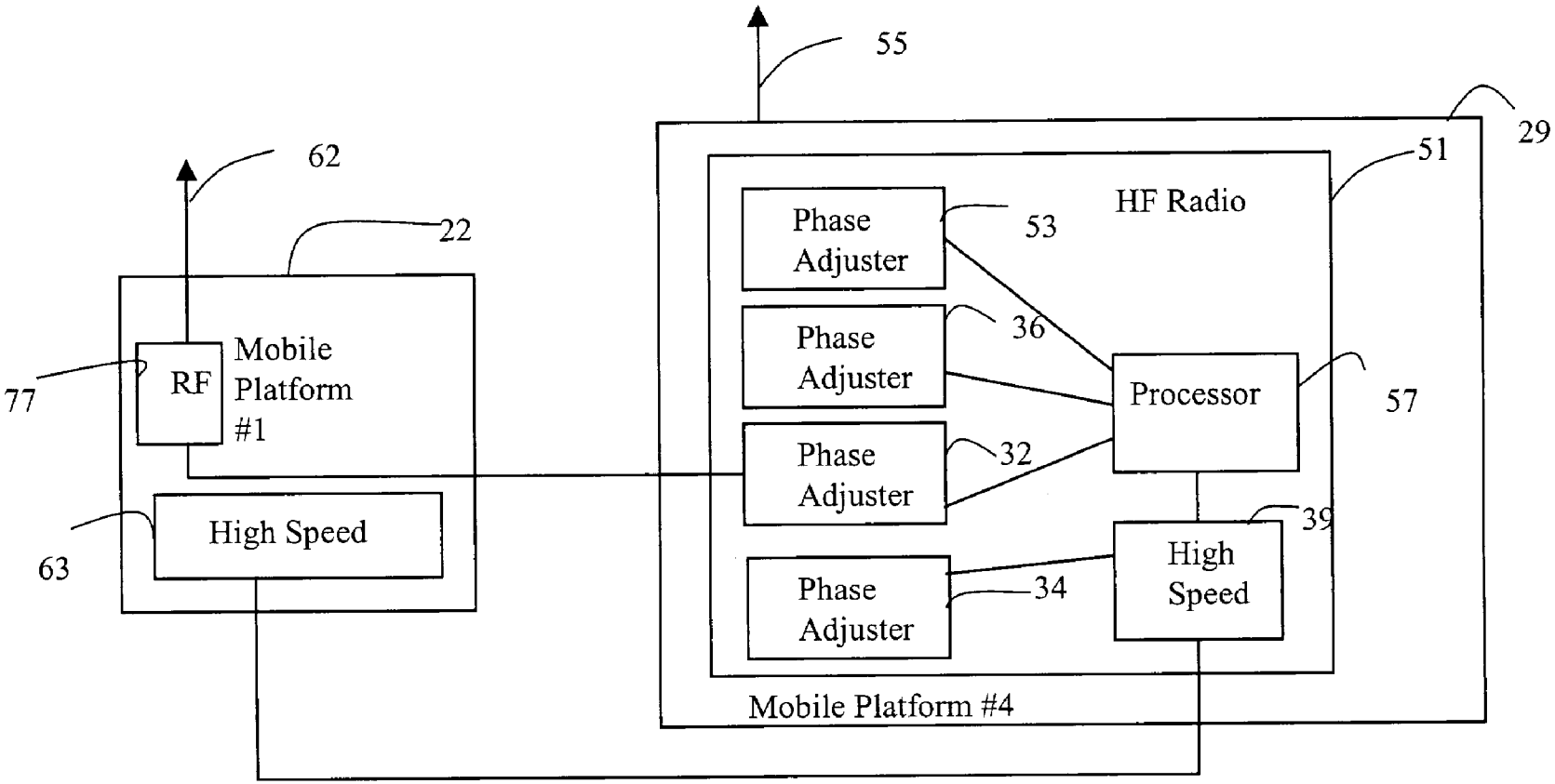
FIG. 6 is a more detailed block diagram showing an embodiment of communication between a mobile platform and a radio system for the radio systems illustrated in FIGS. 2-5.

With reference to FIG. 6, connections and communications between mobile platform 22 and HF radio unit 29 on mobile platform 61 are described in more detail. Unit 29 is similar to units 12 and 51. Although only a connection between platform 22 and radio unit 51 (FIG. 1) is shown, the connection can be similar for platforms 24, 26 and 28. In FIG. 6, HF radio unit 29 (an embodiment of radio unit 51 in FIG. 1) includes a processor 57, high speed interface unit 36, phase adjusters 32, 34, 36, 38 and 53. As discussed above and with reference to FIG. 2, a most preferred embodiment provides adjusters 32, 34, 36 and 38 as part of computer/radio units on each of platforms 22, 24, 26 and 28, respectively. Alternatively, adjuster 32 can be located anywhere between platform 22 and unit 51.

HF radio unit 29 makes adjustments to phase for signals on antenna 62 through phase adjuster 32. A transmitted signal provided from processor 27 through adjuster 32 is provided to RF circuit 77 associated with the antenna 62 on platform 22. Phase adjuster 32 modifies the signal provided to platform 22 so that antennas 62, 64, 66 and 68 (FIG. 1) appear as a larger virtual antenna.

High speed data interface 63 and 39 are utilized to communicate information, such as, position information, relative position information, and antenna type information, and other information necessary to provide transmission reception by radio unit 29. A received signal at antenna 62 is provided through RF circuit 77 to phase adjuster 32 to processor 57. Processor 57 adjusts the phase of the received signal via phase adjuster 32 in response to information received from high speed communication interfaces 63 and 39. Phase adjuster 32 modifies the received signal so that antenna 62, 64, 66 and 68 (FIG. 1) appear as a larger virtual antenna.

Location information or relative location information provided across high speed interfaces 39 and 63 can be determined by the computers on platforms 22, 24, 26 and 28, by using GPS receivers disposed on each of the platforms. Alternatively, a triangulation technique can be utilized to provide precise relative positioning by using signals transmitted and received on high speed interfaces 63 and 39. Precise location or coordinates on the earth are not necessary as long as relative location is accurate (preferably within several centimeters or less). In one embodiment, positioning signals are relaxed from each of platforms 22, 24, 26 and 28 to determine relative location based upon the relative timing of the reception of the signals.

Figure 7:
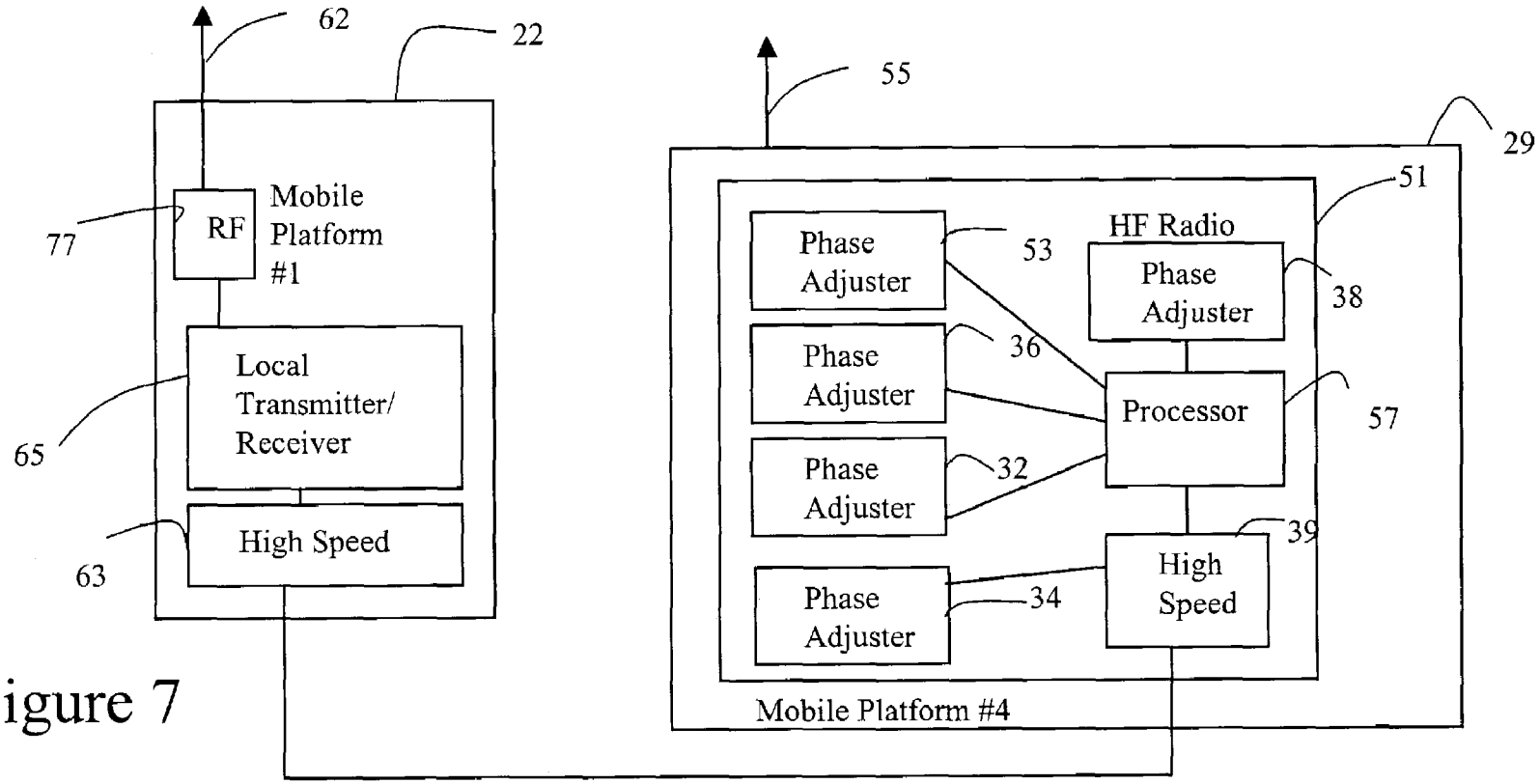
FIG. 7 is a more detailed block diagram showing another embodiment communication between a mobile platform and a radio system for the radio systems illustrated in FIGS. 2-5.

With reference to FIG. 7, HF radio unit 29 provides communications between unit 51 and mobile platforms 22, 24, 26 and 28 (FIG. 1) through high speed interfaces 39 and 63. The communications include the position information and the data received from and sent to antenna 62. Processor 57 provides phase adjustment via adjuster 32 through high speed interfaces 39 and 63. Local transmitter/receiver 65 provides the adjusted signal as a transit signal to RF circuit 77. RF circuit 77 provides the signal to antenna 62. The transmitted signal is adjusted via processor 57 and phase adjuster 32 and provided through high speed interfaces 39 and 63 to local transmitter/receiver 65 so that antenna 62 appears as part of a larger virtual antenna.

Similarly, a received signal is provided from antenna 62 through RF circuit 77, local transmitter/receiver 65, high speed communication interfaces 63 and 39 to processor 57. Processor 57 makes phase adjustments through phase adjuster 32 so that antenna 62 appears as part of a larger antenna.

Figure 8:
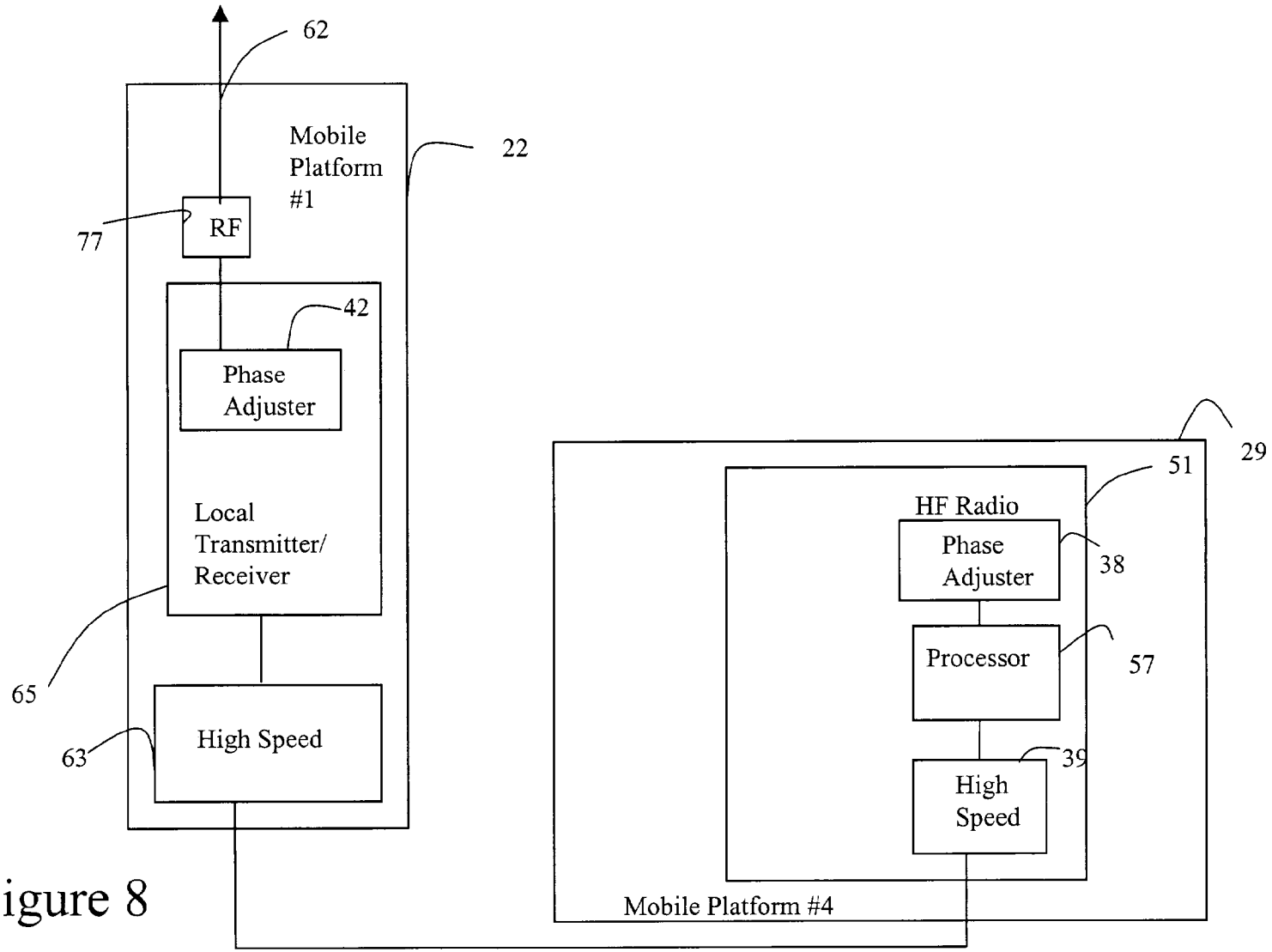
FIG. 8 is a more detailed block diagram showing yet another embodiment communication between a mobile platform and a radio system for the radio systems illustrated in FIGS. 2-5.

With reference to FIG. 8, phase adjuster 32 is employed on a mobile platform 22. Phase adjuster 32 is adjusted by providing control signals through high speed interfaces 39 and 63. Therefore, in addition to position and antenna information provided between HF radio 29 and mobile platform 22, phase adjuster information is provided to adjuster 32 through interfaces so that antennas 62, 64, 66 and 68 appear as a larger virtual antenna. Local transmitter/receiver 65 can be an HF radio unit including phase adjuster 32.

Systems 14, 94, 114, 214 can be used with other HF propagation paths, such as HF skywave. Alternatively, different frequencies, antennas, and radios could be used for meteor burst or troposcatter applications.

It is understood that although the detail drawings, specific examples in particular values described exemplary embodiments of an (HFNVIS) radio system, they are for purposes of illustration only. The exemplary embodiments are not limited to the precise details and descriptions described herein. For example, although particular ranges and architectures are described, other ranges and architectures could be utilized according to the principles of the present invention. Various modifications may be made and the details disclosed without departing from the spirit of the invention as defined in the following claims.

What is claimed is:

1. A beyond line-of-sight system, comprising a plurality of antennas, a plurality of phase adjusters, and a transmitter/receiver unit, wherein each of the phase adjusters is associated with a respective antenna of the antennas, the antennas being disposed on separate platforms, the transmitter/receiver unit communicating with the phase adjusters, whereby the communicating allows the beyond line-of-sight system to use the antennas as a larger virtual antenna, and wherein the beyond line-of-sight system is a beyond line-of-sight terrestrial communications system.

2. The beyond line-of-sight system of claim 1, wherein the system includes three or more antennas, and three or more phase adjusters, the three or more antennas being mounted on three or more distinct platforms.

3. The beyond line-of-sight system of claim 1, wherein the transmitter/receiver unit determines a relative position for each of the antennas.

4. The beyond line-of-sight system of claim 3, wherein the transmitter/receiver unit adjusts the phase adjusters in accordance with the relative position for each of the antennas.

5. The beyond line-of-sight system of claim 4, wherein the antennas are coupled to local transmitter/receivers, wherein each of the antennas is coupled to a respective local transmitter/receiver, the local transmitter/receiver and the transmitter/receiver unit communicating via a high speed communication link.

6. The beyond line-of-sight system of claim 5, wherein each of the local transmitter/receivers include an infrared, radio frequency, or optical interface for communicating with the transmitter/receiver unit.

7. The beyond line-of-sight system of claim 5, wherein transmit signals are provided to the antennas by the transmitter/receiver unit, wherein a separate transmit signal is provided to a respective transmitter/receiver of the local transmitter/receivers, the separate transmit signal is provided in relation to at least one of the transmit signals so that the antennas are a larger virtual antenna.

8. The beyond line-of-sight system of claim 7, wherein the phase adjusters are part of the transmitter/receiver unit.

9. The beyond line-of-sight system of claim 1, wherein a transmit signal is provided to the antennas through the phase adjusters by the transmitter/receiver unit, wherein the transmit signal is adjusted by the respective phase adjuster before the transmit signal reaches the antenna.

10. The beyond line-of-sight system of claim 9, wherein the phase adjusters are disposed on the platforms.

11. The beyond line-of-sight system of claim 1, wherein the transmitter/receiver unit includes an associated antenna of the antennas and at least one phase adjuster associated with the associated antenna.

12. In a communication system including at least a plurality of antennas, a radio unit comprising:

a high speed communication interface; and a processor coupled to the high speed communication interface, the processor receiving information from the high speed interface, the information being associated with a position, relative position, or orientation of the antennas, the processor adjusting phase associated with signals transmitted from or received on the antennas in response to the information;

wherein the plurality of antennas are disposed upon mobile terrestrial platforms and wherein the communication system is configured for beyond line-of-sight communications.

13. The radio unit of claim 12, wherein the information includes antenna information about characteristics of at least one of the antennas.

14. The radio unit of claim 13, further comprising:

an environment sensor, wherein the processor adjusts the phase in response to environment information from the environment sensor.

15. The radio unit of claim 13, further comprising:

an auxiliary HF antenna receiving the signals transmitted from the antennas and providing a phase adjust feedback signal to the processor.

16. A method of operating a beyond line-of-sight system including a plurality of antennas, the method comprising:

receiving signals indicating a position or a relative position of the antennas; and adjusting phase of signals received on or transmitted to the antennas to cause the antennas to operate as a larger virtual antenna;

wherein the plurality of antennas are disposed upon mobile terrestrial platforms and wherein the communication system is configured for beyond line-of-sight communications.

17. The method of claim 16, wherein the signals indicate position or relative position to an accuracy of 1 cm or less.

18. The method of claim 16 wherein the receiving step is performed by a radio unit for an HF NVIS radio system.

19. The method of claim 16 wherein the system is a troposcatter system or a meteor burst system.

20. The method of claim 16 wherein the position or relative position is determined by triangulation.

21. The method of claim 16 wherein the position or the relative position is determined by GPS information.

* * * * *